US009704337B2

(12) United States Patent
Riggs et al.

(10) Patent No.: US 9,704,337 B2
(45) Date of Patent: Jul. 11, 2017

(54) WAGERING GAME METHOD, GAMING MACHINE, GAMING SYSTEM, AND PROGRAM PRODUCT PROVIDING PROGRESSIVE PRIZE CONTROL

(71) Applicant: Multimedia Games, Inc., Austin, TX (US)

(72) Inventors: Keith Riggs, Austin, TX (US); J P Cody, Austin, TX (US)

(73) Assignee: Everi Games Inc., Austin, TX (US)

( * ) Notice: Subject to any disclaimer, the term of this patent is extended or adjusted under 35 U.S.C. 154(b) by 190 days.

(21) Appl. No.: 13/720,790

(22) Filed: Dec. 19, 2012

(65) Prior Publication Data

US 2013/0157757 A1 Jun. 20, 2013

Related U.S. Application Data

(60) Provisional application No. 61/578,151, filed on Dec. 20, 2011.

(51) Int. Cl.
*G07F 17/32* (2006.01)

(52) U.S. Cl.
CPC ..... *G07F 17/3258* (2013.01)

(58) Field of Classification Search
None
See application file for complete search history.

(56) References Cited

U.S. PATENT DOCUMENTS

| | | | | |
|---|---|---|---|---|
| 6,626,758 | B1 | 9/2003 | Parham et al. | |
| 7,575,517 | B2 | 8/2009 | Parham et al. | |
| 7,811,168 | B2 | 10/2010 | Parham et al. | |
| 7,871,328 | B2 | 1/2011 | Parham et al. | |
| 7,887,415 | B2 | 2/2011 | Parham et al. | |
| 8,449,380 | B2 * | 5/2013 | Baerlocher et al. | 463/25 |
| 2006/0277100 | A1 | 12/2006 | Parham | |
| 2008/0167117 | A1 * | 7/2008 | Moshal et al. | 463/25 |
| 2009/0042643 | A1 * | 2/2009 | Gagner et al. | 463/27 |
| 2009/0197674 | A1 | 8/2009 | Parham et al. | |
| 2011/0130196 | A1 | 6/2011 | Parham et al. | |

* cited by examiner

*Primary Examiner* — Jay Liddle
*Assistant Examiner* — Alex F. R. P. Rada, II
(74) *Attorney, Agent, or Firm* — Nathan Calvert, Esq.; Russell D. Culbertson, Esq.; J P Cody, Esq.

(57) ABSTRACT

A progressive gaming method may be conducted in a distributed fashion without a progressive controller. In such a method game play inputs are received through a respective player input system of each of two or more gaming machines. Each game play input defines a wager for a respective play of a wagering game. A progressive contribution value for each respective wager is calculated and a local progressive register value is incremented by that calculated amount. Calculating the progressive contribution value and incrementing the local progressive register value may each be performed at the gaming machine at which the respective wager is defined, and these calculated progressive contribution values are then communicated to each other gaming machine of the two or more gaming machines. Each gaming machine maintains a total progressive value based on the locally calculated progressive contribution values and the values communicated from other gaming machines.

20 Claims, 6 Drawing Sheets

WAGERING GAME METHOD, GAMING MACHINE, GAMING SYSTEM, AND PROGRAM PRODUCT PROVIDING PROGRESSIVE PRIZE CONTROL

CROSS-REFERENCE TO RELATED APPLICATION

The Applicants claim the benefit, under 35 U.S.C. §119 (e), of U.S. Provisional Patent Application No. 61/578,151 filed Dec. 20, 2011, and entitled "Wagering Game Method, Gaming Machine, Gaming System, and Program Product Providing Progressive Prize Control." The entire content of this provisional application is incorporated herein by this reference.

TECHNICAL FIELD OF THE INVENTION

This invention relates to wagering games which provide progressive prizes. More particularly, the invention relates to wagering games, gaming machines, gaming systems, and associated methods and program products providing progressive prizes which may be administered without a centralized progressive game controller.

BACKGROUND OF THE INVENTION

Numerous types of wagering games have been developed in an attempt to provide players with new and varied gaming experiences. In addition to providing different wagering games with different primary games and various different types of bonus or secondary games, game systems may offer various types of payout schedules in different wagering games and may vary the payout volatility of the games. Progressive prizes represent another feature which may be offered in gaming systems to increase player interest. Progressive prizes are prizes which are based at least in part on wagering activity in the gaming system and thus vary over the course of play. In progressive gaming systems, some fraction of each wager in the gaming system is allocated to one or more progressive prize pools. These progressive prize pools are used to pay progressive prizes in response to progressive prize triggering events. One advantage of a progressive gaming system is that the progressive pools may be allowed to grow to very large values and thus provide players with an opportunity to win very large progressive prizes, prizes far in excess of prizes that may be defined in a fixed payout table.

There remains a need in the field of wagering games for systems and arrangements to enhance the player's gaming experience and encourage the player to continue play at a given gaming facility. In particular, there remains a need for progressive gaming systems which maintain player excitement and enhance the gaming experience while reducing the cost of administering the progressive game.

SUMMARY OF THE INVENTION

A method for providing a progressive prize according to some forms of the present invention is conducted in a distributed fashion without a progressive controller. In these forms of the invention the method may include receiving one or more game play inputs through a respective player input system of each of two or more gaming machines. Each game play input defines a wager for a respective play of a wagering game. A progressive contribution value for each respective wager is then calculated and a local progressive register value is incremented by that calculated amount. In the controllerless forms of the invention, these steps of calculating the progressive contribution value and incrementing the local progressive register value are each performed at the respective gaming machine at which the respective wager is defined. In order to facilitate progressive games available through multiple gaming machines, some controllerless forms of the invention may include communicating the respective progressive contribution value to each other gaming machine of the two or more gaming machines. Each gaming machine receives the respective progressive contribution value calculated for a respective wager at that gaming machine, and also, receives each progressive contribution value communicated from another one of the gaming machines, and uses these progressive contribution values to maintain a total progressive value. The total progressive value comprises the total cumulative value of all calculated progressive contribution values. Each gaming machine also may display the total progressive value at a display device associated with that respective gaming machine. Then, in response to a progressive prize winning event at one of the gaming machines, that gaming machine awards at least a portion of the current total progressive value for the progressive prize winning event.

In some forms of progressive gaming systems according to the present invention, a player at a given gaming machine in the system may opt in or out of one or more progressive games available at the gaming machine. In these forms of the invention, the player at a given gaming machine may use the player input system associated with the gaming machine to make a progressive participation input to place the gaming machine in a progressive game participation state. The given gaming machine may only perform the local progressive value calculation and related steps when the gaming machine is in the progressive game participation state.

In forms of the present invention in which a player may opt in or out of progressive play, a method according to the invention may include adjusting a payout rate at the respective gaming machine in response to the progressive participation input. Alternatively, or in addition to adjusting the payout rate to facilitate progressive play at the given gaming machine, a method according to the present invention may include adding a progressive wager amount to a base wager amount to produce the defined wager amount for a respective play of the wagering game at that gaming machine. The base wager amount in this case may be an amount selected by the player through the respective player input system for that gaming machine.

Alternate forms of the present invention may employ a group display controller associated with a group display device for a group of gaming machines for performing some or all of the progressive play calculations. For example, rather than communicating the local progressive contribution value to each other participating gaming machine, each gaming machine may communicate the local progressive contribution value to the group display controller. The group display controller serves as a progressive play host controller and adds these local progressive contribution values to maintain the total progressive value. The group display controller may then control the group display device to display the total progressive value. The group display controller may also periodically communicate the total progressive value to all of the gaming machines participating in the progressive game, so that each gaming machine may display the total progressive value to the player participating at that gaming machine.

Progressive gaming systems according to the present invention are not limited to any particular type of progressive prize winning event. A progressive prize winning event may or may not be associated with a result obtained for a given game play at a given gaming machine. For example, a progressive prize winning event may be determined or produced randomly at each respective gaming machine or at the group display controller or at some other controller included in the gaming system.

In addition to progressive gaming methods and systems, the invention also encompasses a program product stored on one or more computer readable data storage devices. Such a program product may include gaming machine program code executable by at least one processor associated with a gaming machine to perform the above-described steps of calculating progressive contribution values in response to game play inputs, incrementing a local progressive register, and communicating the progressive contribution values to each other gaming machine or a group display controller serving as a progressive play host. The gaming machine program code may also be executable to calculate the total progressive value or may receive the total progressive value from the group display controller. Regardless of how the total progressive value is maintained, the gaming machine program code may also be executable to award at least a portion of the current total progressive value for the progressive prize winning result in response to a progressive prize winning event at the respective gaming machine or elsewhere in the gaming system. In implementations relying on a group display controller, the program product may include host controller program code executable by at least one processor associated with group display controller to receive the progressive contribution values from the various gaming machines and maintain the total progressive value.

These and other advantages and features of the invention will be apparent from the following description of illustrative embodiments, considered along with the accompanying drawings.

DESCRIPTION OF ILLUSTRATIVE EMBODIMENTS

In the following description, FIGS. 1-5 will be used to describe gaming machines embodying principles of the invention, and a gaming network in which the gaming machines may be connected. FIG. 6 will be used to describe various processes by which progressive games may be controlled according to various embodiments of the present invention.

Figure 1:
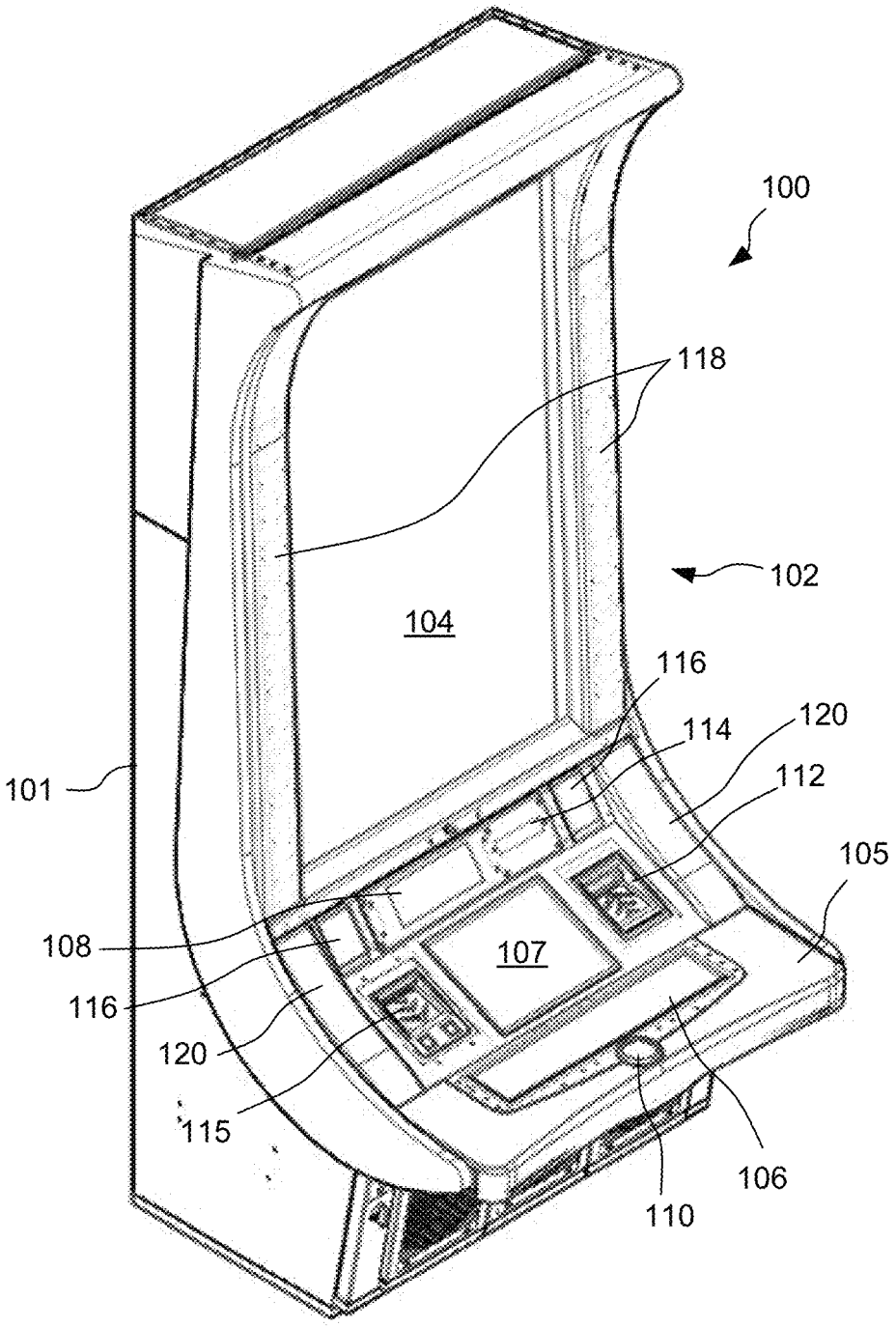
FIG. 1 is an isometric view of a gaming machine which may be used in various embodiments of the present invention.

Referring to FIG. 1, a gaming machine 100 includes a cabinet 101 having a front side generally shown at reference numeral 102. A primary video display device 104 is mounted in a central portion of the front surface 102, with a button panel 106 positioned below the primary video display device and projecting forwardly from the plane of the primary video display device. In this particular implementation, button panel 106 comprises a touchscreen display device mounted in an arm rest structure 105. In addition to primary video display device 104, the illustrated gaming machine 100 includes an additional video display device 107 which is also preferably a touchscreen display and is positioned in between the primary video display device and button panel 106. The display surface of display device 107 is inclined at an angle to provide a comfortable viewing angle to a player standing or sitting in front of gaming machine 100 with their hands in position to reach button panel 106, display device 107, and perhaps the lower portion of primary display device 104. Gaming machine 100 also includes an additional smaller auxiliary display device 108 located between primary display device 104 and display device 107. Auxiliary display device 108 may also comprise a touchscreen device. It should also be noted that each display device referenced herein may include any suitable display device including a cathode ray tube, liquid crystal display, plasma display, LED display, OLED display, or any other type of display device currently known or that may be developed in the future. As will be described further below in connection with FIG. 2 and elsewhere, it is also possible for gaming machines within the scope of the present invention to include mechanical elements such as mechanical reels.

The gaming machine 100 illustrated for purposes of example in FIG. 1 also includes a mechanical control button 110 mounted on arm rest structure 105. Mechanical control button 110 may comprise a "Play" button which may be used to initiate a play in a game at the gaming machine, or may comprise a programmable, multi-function button. It will be appreciated that virtual buttons or other controls to allow a player to select a bet level, select pay lines, select a type of game or game feature, make a progressive participation input, and actually start a play in a primary game may also be implemented on touchscreen button panel 106. Other forms of gaming machines through which the invention may be implemented may include switches, joysticks, buttons, or other mechanical input devices, along with the virtual buttons and other controls implemented on touchscreen displays such as touchscreen button panel 106. For example, the lower areas of primary video display device 104 in gaming machine 100 provides a convenient display device for implementing touchscreen controls in addition to or in lieu of mechanical controls or touchscreen controls located elsewhere. Mechanical input devices in addition to the single mechanical button 110 may be conveniently located in areas of arm rest 105 not taken up by touchscreen devices. The mechanical or touchscreen-implemented player interface devices which receive player inputs to initiate the play of a game through the gaming machine, such as controls to select a wager amount for a given play and control to actually start a given play, may be referred to generally as a player interface system.

It will be appreciated that gaming machines may also include a number of other player interface devices included in the player interface system in addition to devices that are considered player controls for use in playing a particular game or opting in for progressive play. Gaming machine 100 also includes a currency/voucher acceptor 112, a player card reader having a player card input 114, and a voucher/receipt printer 115. Numerous other types of player interface devices may be included in gaming machines that may be used according to the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine. An additional speaker may be included above primary display device 104, but is not shown in the perspective of FIG. 1.

Although not shown in the drawings, a gaming machine through which forms of the present progressive gaming system may be implemented may also include a video camera located so as to capture video or still images of a player operating the gaming machine. Such a gaming machine camera may be operatively connected to be controlled through CPU 205, or through the separate processing system 222. Examples of uses of such a video camera in connection with progressive gaming will be described below.

Gaming machine 100 further includes a cabinet accent lighting system for providing accent lighting effects in coordination with events at the gaming machine or otherwise. The illustrated embodiment includes a cabinet accent lighting system having elongated upper accent light fixtures 118 which may include a number of LEDs or other types of lights to provide various lighting effects on either side of primary display device 104. Lower elongated accent light fixtures 120 are also included on either side of the cabinet 101 between the level of primary display device 104 and touchscreen button panel 106.

Figure 2:
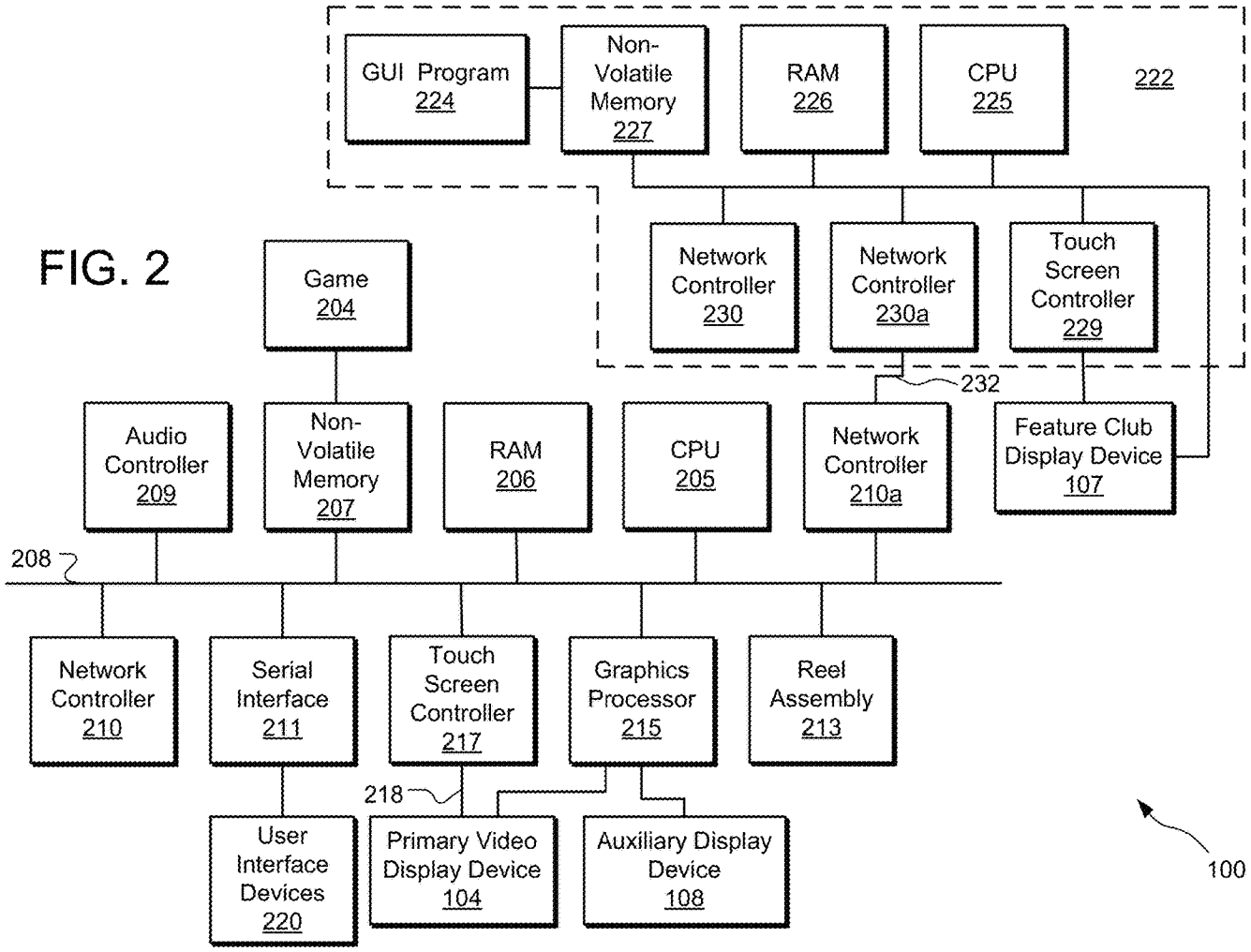
FIG. 2 is a diagrammatic representation showing various components of a gaming machine which may be employed according to one or more embodiments of the present invention.

FIG. 2 shows a diagrammatic representation of gaming machine 100 which includes a central processing unit (CPU) 205 along with random access memory (RAM) 206 and nonvolatile memory or storage device 207. All of these devices are connected on a system bus 208 with an audio controller device 209, a network controller 210, a second network controller 210*a*, and a serial interface 211. A graphics processor 215 is also connected on bus 208 and is connected to drive primary video display device 104 and auxiliary display device 108 (both mounted on cabinet 101 as shown in FIG. 1). As shown in FIG. 2, gaming machine 100 also includes a touchscreen controller 217 connected to system bus 208. Touchscreen controller 217 is also connected via signal path 218 to receive signals from a touchscreen element associated with primary video display device 104. It will be appreciated that the touchscreen element may comprise a thin film that is secured over the display surface of primary video display device 104. The touchscreen element itself is not illustrated or referenced separately in the figures.

The diagrammatic representation of FIG. 2 also shows gaming machine 100 as including a separate second processing system 222 which may comprise a single board computer. The second processing system 222 is included in the illustrated gaming machine 100 for providing processing functions which may be associated with progressive play as will be discussed further below in connection with FIG. 6. However, alternate implementations of a gaming machine within the scope of the present invention may use game processor 205 to provide processing functions associated with progressive play, or at least some of the progressive play processing functions.

Second processing system 222 includes CPU 225, with its own random access memory (RAM) 226, and non-volatile memory 227, such as a suitable disk-based or solid state hard drive for storing program code 224 which may be executed by CPU 225. Processing system 222 also includes network controllers 230 and 230*a*, and touchscreen controller 229 connected to a suitable touchscreen film or other touch-registering element associated with display device 107.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, 210*a*, and 211 shown in FIG. 2 are elements commonly associated with a personal computer. These elements may be mounted on a standard personal computer chassis and housed in a standard personal computer housing which is itself mounted in cabinet 101 shown in FIG. 1. Alternatively, the various electronic components may be mounted on one or more circuit boards housed within cabinet 101 without a separate enclosure such as those found in personal computers. Second processing system 222 may comprise a single board computer mounted within cabinet 101 or within a separate EMI shielded enclosure within the cabinet. Those familiar with data processing systems and the various data processing elements shown in FIG. 2 will appreciate that many variations on this illustrated structure may be used within the scope of the present invention. For example, since serial communications are commonly employed to communicate with a touchscreen controller such as touchscreen controller 217, the touchscreen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104, CPU 205 may control all of the display devices directly without any intermediate graphics processor. Similarly, although processing system 222 is shown as including no separate graphic processor for controlling display device 107 (thus implying that the graphics processing for display device 107 is handled by CPU 225 or perhaps a graphics processor packaged with CPU 225), implementations of the invention may include a processing system such as system 222 with a separate graphics processor. The invention is not limited to any particular arrangement of processing devices for controlling the video display devices included with gaming machine 100. Also, a gaming machine implementing the present invention is not limited to any particular number of video display devices or particular types of display devices.

In the illustrated gaming machine 100, CPU 205 executes software which ultimately controls primary game play and related functions and any secondary or other game play, including the receipt of player inputs and the presentation of the graphic symbols displayed in the course of game play through the display devices 104 and 108 associated with the gaming machine. Thus CPU 205 may be referred to as a "game processor." CPU 205 also executes software related to communications handled through network controllers 210 and 210*a*, and software related to various peripheral devices such as those connected to the system through audio controller 209, serial interface 211, and touchscreen controller 217. CPU 205 may also execute software to perform accounting functions associated with play of the primary game. Random access memory 206 provides memory for use by CPU 205 in executing its various software programs while the nonvolatile memory or storage device 207 may comprise a hard drive or other mass storage device providing storage for game software such as game program code 204 prior to loading into random access memory 206 for execution, or for programs not in use or for other data generated or used in the course of gaming machine operation. Network interface 210 provides an interface to other components of a gaming system in which gaming machine 100 may be included. An example network will be described below in connection with FIG. 5. Network controller 210*a* provides an interface to the separate processing system 222 via network controller 230*a* and crossover cable 232. Other implementations employing separate processing system 222 may not include network controller 230*a*, and may rely on communications through network controller 230 for any communications with the processing system using CPU 205.

It should be noted that the invention is not limited to gaming machines employing the personal computer-type arrangement of processing devices and interfaces shown in example gaming machine 100. Other gaming machines through which progressive gaming systems may be implemented may include one or more special purpose processing devices to perform the various processing steps for implementing the present invention. Unlike general purpose processing devices such as CPU 205, which may comprise an Intel Pentium® or Core® processor for example, these special purpose processing devices may not employ operational program code to direct the various processing steps.

The example gaming machine 100 which may be used to implement some embodiments of the present invention is shown in FIG. 2 as including user interface devices 220 connected to serial interface 211. These user interface devices may include various player input devices such as touchscreen button panel 106 in FIG. 1, and/or levers, and other devices. It will be appreciated that the interface between CPU 205 and other player input devices such as player card readers, voucher readers or printers, and other devices may be in the form of serial communications. Thus user serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the invention may include mechanical reels. For example, a set of mechanical reels may replace the primary display device 104, or at least part of that display device. Alternatively, mechanical reels may be included in the gaming machine behind a light-transmissive video display panel. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface controller 211 to control communications with the reel assembly, and may not include a direct interface as indicated by FIG. 2. Details of a mechanical reel arrangement are not shown in the present figures so as to avoid obscuring the present invention in unnecessary detail.

It will be appreciated that the diagrammatic representation shown in FIG. 2 is shown only to provide an example of how gaming machine 100 may be configured for use in a progressive gaming system according to the present invention. Numerous variations on this generalized configuration are possible within the scope of the present inventions. For example, display device 107 may be controlled through processor 205 (directly or through another graphics processor communicating with processor 205) and without the separate processing system 222. Also, as noted above, an alternate processing arrangement for controlling display device 107 may not communicate directly with the processing system including CPU 205. In this latter arrangement, network controllers 230*a* and 210*a* would be eliminated from the system.

Figure 3:
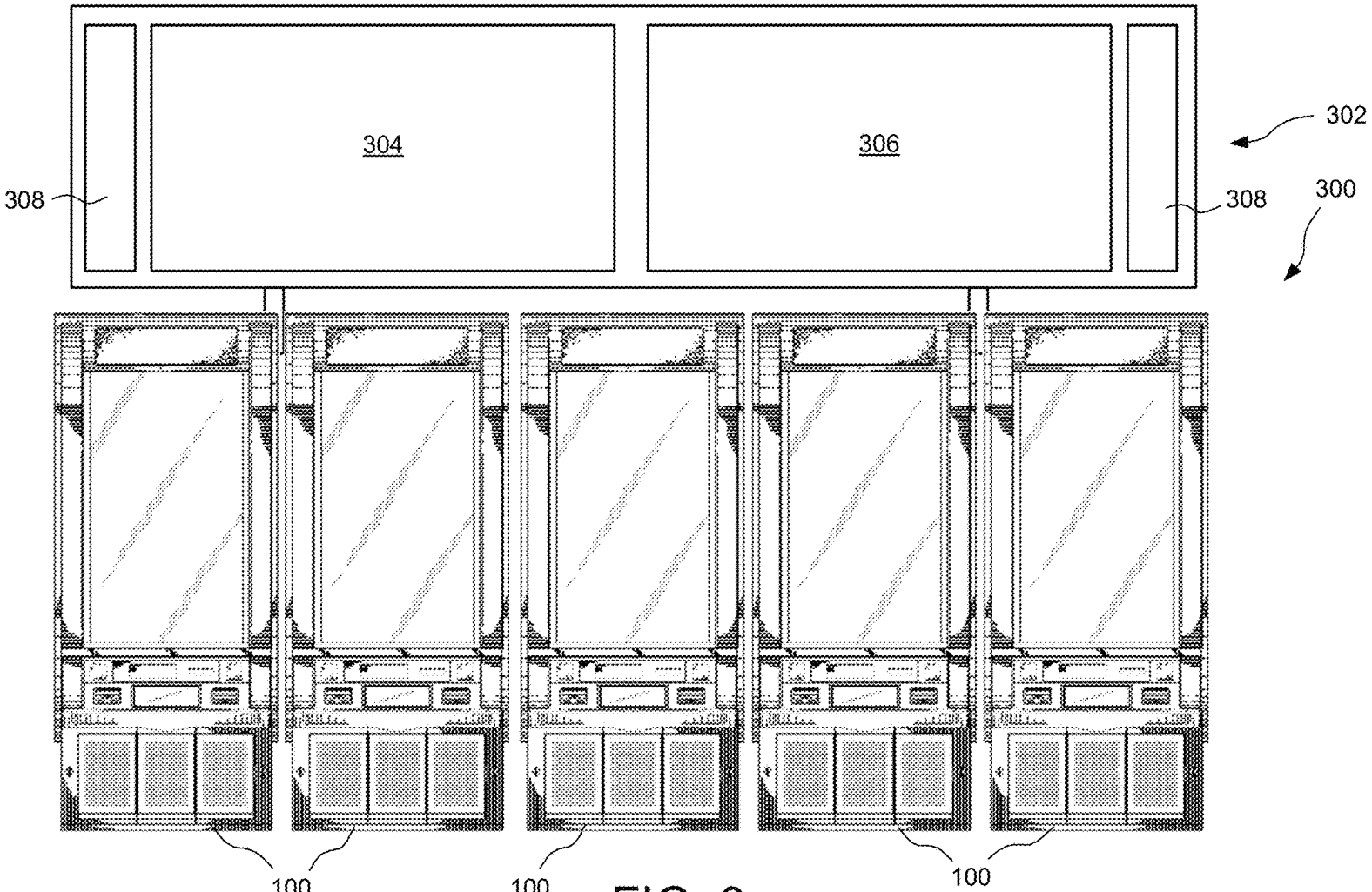
FIG. 3 is a somewhat diagrammatic representation of a bank of gaming machines which may be connected together for providing progressive game play according to various embodiments of the present invention.

FIG. 3 shows a bank 300 of gaming machines 100 together with a group display arrangement 302 shown supported above the gaming machines. The particular group display arrangement 302 shown for purposes of example in FIG. 3 includes two separate video display devices 304 and 306 along with audio speakers 308. It will be appreciated that an additional row of gaming machines 100 may be arranged in bank 300 back-to-back with the row of gaming machines shown in the figure. In such an arrangement of two rows of gaming machines 100, the group display arrangement may include an additional set of display devices and audio speakers (not shown in FIG. 3) facing in the opposite direction from the direction in which the illustrated display devices 304 and 306 and speakers 308 face.

Display devices 304 and 306 associated with group display arrangement 302 may be used for progressive play functions and for functions unrelated to progressive play. For example, one or both of display devices 304 and 306 may be used to periodically or continuously display a total progressive value for progressive play according to the invention. Where there are multiple progressive pools, this may include displaying more than one total progressive value, one for each separate pool. Group video display devices 304 and 306 may also be used to provide various announcements or interesting graphic effects associated with the play of games at gaming machines 100. An example of such a use includes displaying an announcement when a particular level of prize (including a progressive prize) has been won at one of the gaming machines 100 in bank 300 or at a gaming machine elsewhere in the gaming facility. Where gaming machines 100 include a video camera for capturing video or other images of a player at the gaming machine, group display devices 304 and 306 may be used to display the images captured from one or more of these gaming machine video cameras. For example, video of a player who has just been awarded a progressive prize according to the invention may be displayed through group display device 304 or 306, or both. Group display devices 304 and 306 may also be used to display competitive play ranking in the course of competitive play, or final results of competitive play at two or more gaming machines 100 in bank 300 or at other gaming machines in the gaming facility.

Figure 4:
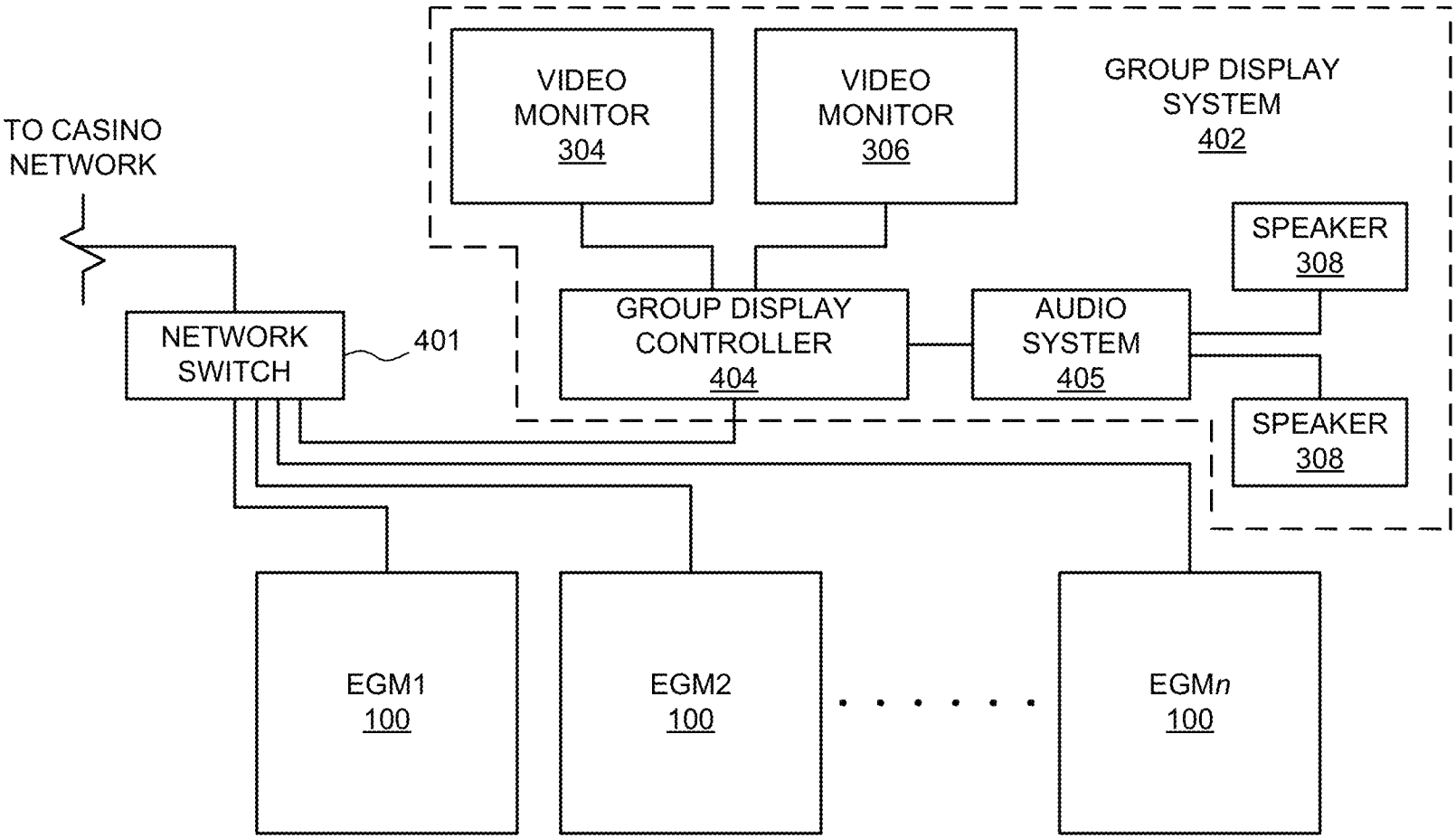
FIG. 4 is a high level diagrammatic representation showing the communications connections between components of a progressive gaming system which may embody forms of the present invention.

FIG. 4 shows a diagrammatic representation of gaming machine bank 300. In particular, FIG. 4 shows each gaming machine 100 (EGM1–n) connected through a network switch 401 to a gaming facility network and to a group display system 402 via a group display controller 404. Group display system 402 includes group display controller 404, video display devices 304 and 306 and perhaps additional video display devices as described above, and an audio system 405 operable to drive speakers 308.

It should be appreciated that the network topography shown in FIG. 4 is shown only for purposes of example and is not intended to limit the present invention to any particular network topography or network communication standard. Any network or communications arrangement between the various devices in the gaming system may be used to provide the communications described below particularly in connection with FIG. 6.

Group display controller 404 may include one or more data processing systems with one or more processors, associated memory devices, a network controller to facilitate the indicated network connection, and appropriate interfaces to video display devices 304 and 306 and audio system 405. Group display controller 404 may operate under the control of program code to provide the various progressive play-related functions discussed below. Alternatively, group display controller 404 may comprise a special purpose processing device which does not require the execution of software to provide the required functions.

Figure 5:
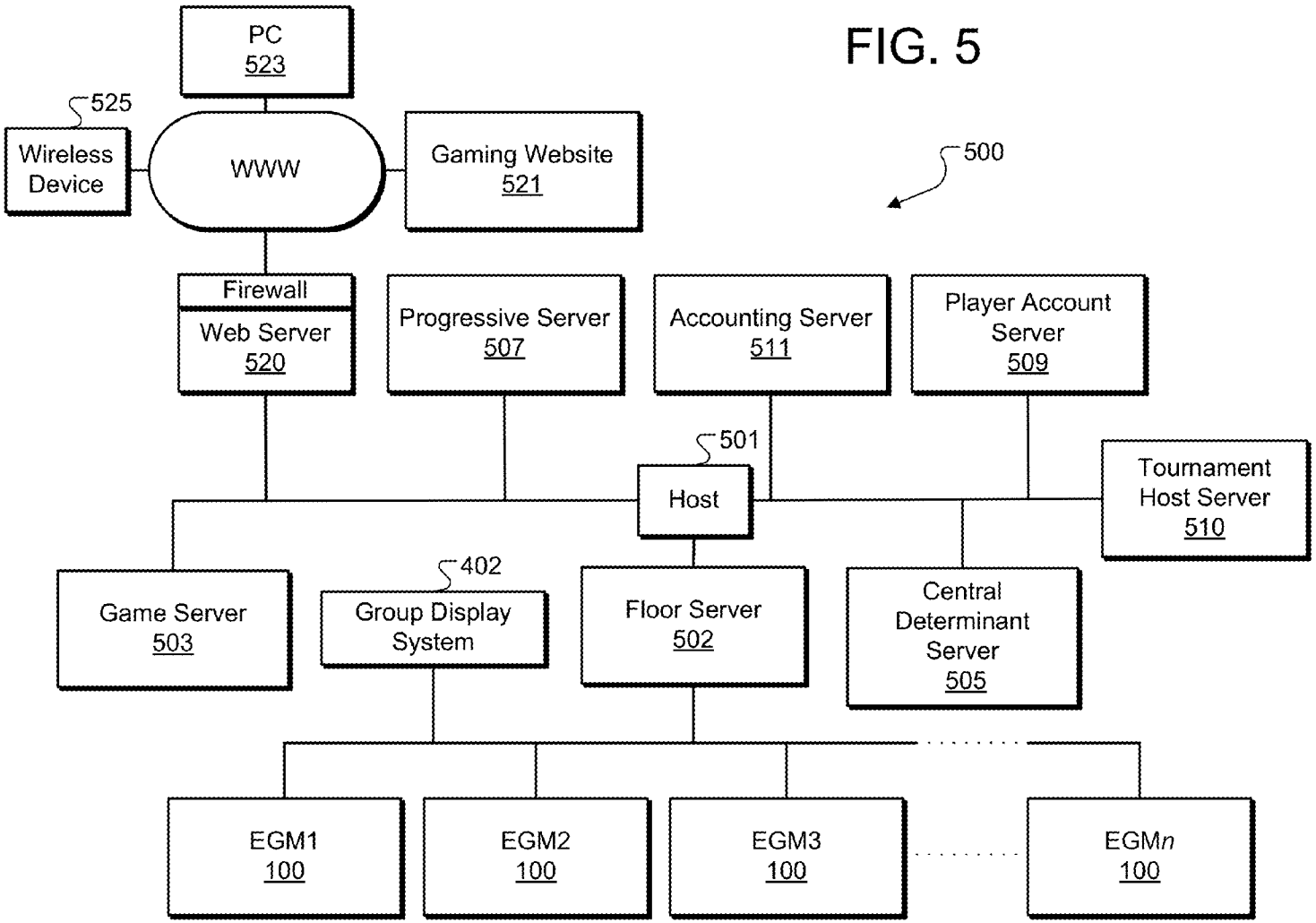
FIG. 5 is a diagrammatic representation of a networked gaming system in which the present invention may be implemented.
Figure 6:
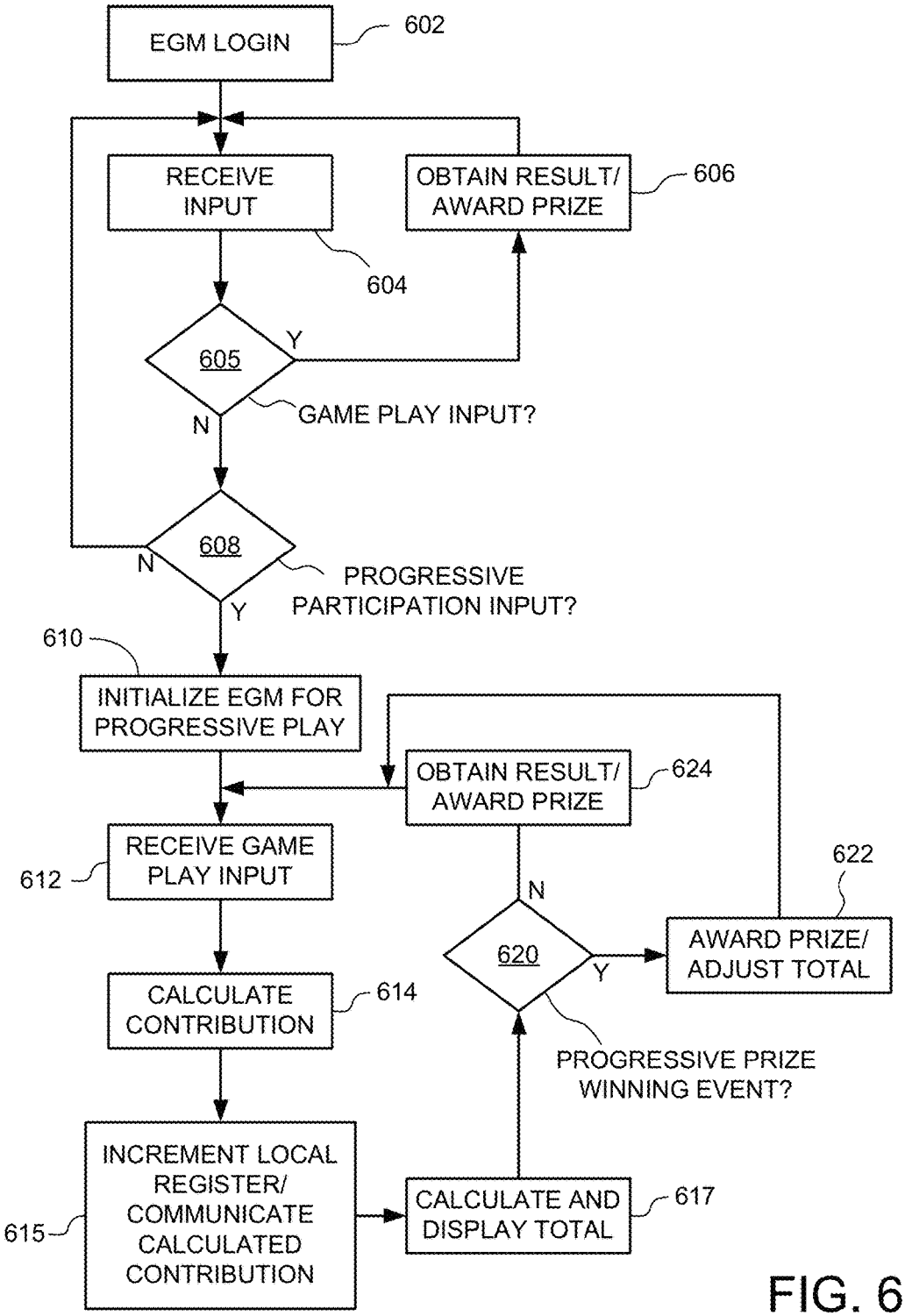
FIG. 6 is a flow chart illustrating processes which may be performed according to various embodiments of the present invention.

Referring now to FIG. 5, a networked gaming system 500 associated with one or more gaming facilities may include one or more networked gaming machines 100 (EGM1–n) connected in the network by suitable network cable or wirelessly. The example gaming network 500 shown in FIG. 5 includes a host server 501 and floor server 502, which together may function as an intermediary between floor devices such as gaming machines 100 and back office devices such as the various servers described below. Game server 503 may provide server-based games and/or game services to network connected gaming devices such as gaming machines 100. Central determinant server 505 may be included in the network to identify or select lottery, bingo, or other centrally determined game outcomes and provide the information to networked gaming machines 100 providing lottery and bingo-based wagering games to players. Although not shown in FIG. 5, a gaming system having gaming machines 100 may also include a player club server. Such a player club server may be connected in the back office network together with progressive server 507, accounting server 511, player account server 509, tournament host server 510, and web server 520. The player club server may function to receive player club communications from the gaming machines 100 to maintain a player club account for each player enrolled in a player club. Alternatively, player club points and other information may be maintained through accounting server 511.

Tournament host server 510 is included in network 500 for supporting the tournament-related processes which may be offered in the gaming system. Tournament qualification and tournament game scoring processes may be performed through tournament host server 510 for example. In particular, tournament host server 510 may receive primary game play and wagering information and entry fee payment information from each gaming machine 100 in order to perform tournament qualification functions. Tournament host server 510 may also receive tournament play information from the various gaming machines 100 participating in a tournament, including a point total for the respective gaming machine. In one tournament implementation, each time a tournament score or point-affecting event occurs at a gaming machine 100, the gaming machine communicates an updated score to tournament host server 510. Once every set period of time (every three seconds for example), tournament host server 510 may determine a current point total for gaming machine 100 participating in the current tournament, rank the point totals to produce a ranking for at least some top number of tournament participants (top five or top ten for example), and then communicate that current ranking to the various participating gaming machines along with the point total for each rank position. Tournament host server 510 may also communicate ranking information and point information to a controller for a group display system 402.

Progressive server 507 may be included in gaming system 500 to facilitate casino-wide progressive games and wide-area progressive games, that is, progressive games in which gaming machines over a large geographic area may participate. These casino-wide and wide-area progressive games are to be distinguished from the progressive play described below in connection with FIG. 6 which may not require a centralized progressive server such as server 507. Gaming machines 100 within the scope of the present invention may participate in progressive play as described in FIG. 6 and/or play in casino wide and wide-area progressive games administered through progressive server 507 and/or other similar servers associated with remote gaming facilities.

Accounting server 511 may receive gaming data from each of the networked gaming devices, perform audit functions, and provide data for analysis programs. Player account server 509 may maintain player account records, and store persistent player data such as accumulated player points in a player club system and/or player preferences (for example, game personalizing selections or options).

Networked gaming machines 100 and one or more displays (such as group display devices 304 or 306 in FIG. 3) may be operatively connected so that the group display devices may mirror or replay the content of one or more displays of gaming machines 100. For example, the primary display content for a given gaming machine 100 may be stored by a display controller or game processor 205 or by some other processor of the given gaming machine and transmitted through network controller 210 as shown in FIG. 2 to a controller (such as controller 404 in FIG. 4) associated with the display devices (such as display devices 304 and 306) included in group display system 402. In the event gaming machines 100 have cameras installed, the respective player's video images may be displayed on displays controlled by group display devices along with the content of the player's gaming machine display.

Example gaming network 500 also includes a gaming website 521 which may be hosted through web server 520 and may be accessible by players via the Internet. One or more games may be displayed as described herein and played by a player through a personal computer 523 or handheld wireless device 525 (for example, a Blackberry® cell phone, Apple® iPhone®, personal digital assistant (PDA), iPad®, etc.). To enter website 521, a player may log in with a user name that may, for example, be associated with the player's account information stored on player account server 509. Once logged onto website 521 the player may play various games on the website. Also, website 521 may allow the player to make various personalizing selections and save the information so it is available for use during the player's a next gaming session at a casino establishment having the gaming machines 100.

It will be appreciated that gaming network 500 illustrated in FIG. 5 is provided merely as an example of a gaming network in which progressive gaming may be offered according to embodiments of the present invention, and is not intended to be limiting in any way. In particular, servers shown separately in the example of FIG. 5 may be combined in a single physical processing device, or the processing duties of the various illustrated servers may be split into additional physical devices. It will be appreciated that each of the servers shown for example in FIG. 5 may comprise one or more data processing devices with one or more central processing units, associated memory, and related devices.

FIG. 6 shows an example process according to certain implementations of the present invention. The process shown in FIG. 6 may be performed entirely at a gaming machine such as gaming machine 100 in some forms of the present invention. However, some forms of the present invention may perform some of the steps shown in FIG. 6 at devices remote from the respective gaming machine, such as group display controller 404. These variations in the particular elements which perform the steps shown in FIG. 6 will be described further below.

The process shown in FIG. 6 begins with a login at a gaming machine (EGM) as shown at process block 602. After logging in to the gaming machine, the gaming machine may be initialized to receive player inputs as shown at process block 604. In the event the gaming machine receives a game play input to initiate play of the game at the gaming machine as indicated by a positive outcome at decision box 605, the gaming machine or some component associated with the gaming machine obtains a result for the game play and may award a prize if the result is a winning result. These steps of obtaining a result and awarding the indicated prize are shown at process block 606. After these steps the process returns to await another player input at 604.

If the gaming machine receives a progressive participation input as indicated by an affirmative outcome and decision box 608, the process proceeds to initialize the gaming machine for progressive play as shown at process block 610. If the input received at process block 608 is not a progressive participation input, the process may perform some other function in response to the input and ultimately may loop back to await another input at 604.

Once the gaming machine is initialized for progressive play according to the step shown at process block 610, a game play input (or a game play input meeting certain requirements for participating in progressive play) received as indicated at process block 612 causes a progressive contribution amount to be calculated as shown at process block 614. A local register is then incremented by the calculated contribution amount as indicated at process block 615 and the calculated contribution amount is also communicated to one or more components in the system responsible for maintaining a total progressive value. This component or components calculate the total as indicated at process block 617 and may also cause the total progressive value to be displayed at a suitable display at the respective component or elsewhere. The process then determines if there has been a progressive prize-winning event. If there has been a progressive prize-winning event as indicated by an affirmative outcome at decision box 620, the process proceeds to award the prize for the progressive prize-winning event and adjusts the total progressive prize value as indicated at process block 622. After awarding the prize and adjusting the total the process returns to receive another game play input at process block 612. Also, if there has been no progressive prize winning event, the illustrated example process obtains a result for the game play input and awards any associated prize for that result as indicated at process block 624 before returning to await another game play input as indicated at process block 612.

Forms of the invention may allow the player to opt out of progressive participation by making an appropriate input at their gaming machine. This opt out input returns the gaming machine to the state in which the process loops as shown at process blocks 604, 605, 606, and 608 until the player either logs out of the gaming machine or enters another progressive participation input. Of course, forms of the invention may allow the player to log out of the gaming machine at a point in the process at which the gaming machine is initialized for progressive play.

Progressive play according to the present invention may be performed in association with any gaming machine login procedure. Gaming machine login may require a player card, a cash input or a voucher input or any other sequence of inputs or actions to place a given machine in a state in which it may receive and respond to game play inputs. Forms of the invention are also not limited to any particular type of inputs to initiate a game play which is received at the gaming machine as indicated at process block 604. Typically, a game play input includes at least activating a "Play" button or handle, and may also include selecting a wager amount, denomination, or numerous other types of player selections or any combination of these selections.

Progressive gaming systems under the present invention are also not limited to any particular arrangement for obtaining results and awarding prizes outside of progressive play at process block 606. Results may be obtained through a random result generator operated at the gaming machine or at a remote location, may be obtained from an electronic lottery ticket set or a bingo game, or by evaluating a set of reels which are randomly stopped to display a matrix of reel symbols, or in any other suitable fashion.

Although FIG. 6 indicates a process in which a gaming machine may be placed in a progressive participation state or in a state in which it does not participate in progressive play, other forms of the invention may not provide such an option. In these forms of the invention, process blocks 604, 605, 606, and 608 may essentially be eliminated. Logging in at the gaming machine or otherwise activating the gaming machine in these cases simply places the gaming machine in position to receive game play inputs as shown at process block 612 and FIG. 6.

In implementations in which the gaming machine is not necessarily in a progressive participation state and must be initialized for progressive play as shown at process block 610, the initialization may include a number of different steps within the scope of the invention. For example, initializing the gaming machine for progressive play may include adjusting a payout rate at the respective gaming machine. In particular the payout rate may be adjusted through a processing device associated with the gaming machine to ensure that the payout for the game or games conducted through the gaming machine allows collection of progressive contributions to fund progressive prizes and still maintains a desired hold for profit for the gaming machine owner or operator. For example, if the player opts in at a gaming machine set at a 92% payout for non-progressive play (leaving a hold percentage of 8%), then the payout rate may be modified to 87% with 5% of wagers set aside into the progressive pool. Alternatively, the initialization indicated at process block 610 may include modifying play at the gaming machine by adding a percentage, some other variable value, or a fixed value (a progressive wager amount) to each wager (base wager amount) placed at the gaming machine and this percentage or fixed or variable value is used to fund the progressive pool. This alternate initialization process may be performed at a processing device associated with the gaming machine. Both of these arrangements allow a given game play to be eligible for a progressive prize even if the player wagers less than a maximum bet or some other qualifying bet level. In other implementations of the invention, a progressive participation input may simply be a wager at some progressive qualifying wager level such as a maximum bet, or a wager plus a progressive play qualifying side bet. In these arrangements, payout rate modification may or may not be required at the gaming machine.

The calculations indicated at process block 614 in FIG. 6 may be performed in a number of different fashions within the scope of the present invention. In some implementations, each gaming machine calculates the progressive contribution for a game play input at that gaming machine. The calculation may be performed under the control of processor 205 in FIG. 2 for example or processor 225 in FIG. 2. Incrementing the local register and communicating the calculated contribution as indicated at process 615 may be performed again either under control of the game processor 205, or a separate processor included at the gaming machines such as processor 225.

The communication indicated at process block 615 depends upon the particular component in the system which performs the calculation shown at process block 614. In some forms of invention, the total progressive value is maintained at each individual gaming machine. In this form of the invention, the communication indicated at 615 is a communication from the individual gaming machine to each other gaming machine participating in progressive play or capable of participating in progressive play if initialized for progressive play. In this case, the calculation indicated at process block 617 is performed separately at each gaming machine in response to the contribution communicated from other gaming machines and the contribution made at that respective gaming machine.

In an alternative arrangement according to the present invention, a processor included in group display controller 404 may be programmed to receive the calculated contributions from each gaming machine participating in progressive play, and may calculate the progressive total value as indicated at process block 617 in FIG. 6. In this case, the gaming machines may or may not each communicate their respective progressive contributions to each other gaming machine. However, group display controller 404 may communicate the total progressive value to each gaming machine so that each gaming machine may display the total at a suitable display device at the gaming machine. Alternatively or in addition to communicating the total progressive value to each gaming machine, group display controller 404 may cause the total progressive value to be displayed at one of the group display video display devices such as video displays 304 and/or 306 shown in FIGS. 3 and 4.

The present invention is not limited to any particular type of progressive prize-winning event which determines the flow of the process from decision box 620. A progressive prize-winning event may be an event such as a particular type of result produced for the game play input received at process block 612. In this case, the step of obtaining a result indicated at process block 624 may be moved to a point in the process flow before decision block 620. Alternatively, progressive prize-winning events may be entirely unrelated to a result for a given game play at the gaming machine. For example, a progressive prize-winning event may be generated randomly either through a processor at the gaming machine or through another processing device elsewhere in the networked gaming system. In the case where the progressive prize winning event is determined remotely from the gaming machine conducting the process shown in FIG. 6, an indication of the progressive prize winning event may be communicated to the gaming machine in any suitable fashion, such as through the network arrangement shown for example in FIG. 5.

The progressive prize awarded as indicated at process block 622 may be the entire total progressive pool value or some fraction of the total. Progressive prizes awarded from the total progressive value as indicated that process block 622 are not limited to any particular method of calculation or prize amount. In any event, the award of a progressive prize causes a credit meter at the progressive prize winning gaming machine to be incremented by the progressive winning amount. Also, the award of a progressive prize at process block 622 affects the total progressive value and thus requires that the total progressive value be decremented by the amount of the award. This adjustment of the total progressive value may be performed at the processing device at each respective gaming machine in systems which rely on the gaming machines to maintain the total progressive value, or may be performed at the group display controller 404 where it is the group display controller which maintains the total progressive value. In the latter case, the adjusted total progressive value may be communicated from the group display controller to each gaming machine participating in the progressive play so that the correct progressive value may be displayed at each gaming machine in addition to or in lieu of a display of that value at display devices controlled directly by the group display controller (such as display devices 304 and 306 shown in FIGS. 3 and 4). In some implementations, once group display controller 404 receives a communication or otherwise determines that there has been a progressive prize winning event for one of the gaming machines, the group display controller may communicate a signal to each non-winning gaming machine to reduce the local progressive register value to a reset amount/starting level, and may communicate the winning progressive amount to the winning gaming machine. Also, group display controller 404 may cause one of the display devices, monitor 304 for example, to show the progressive winning game presentation (when the presentation shows the progressive win) along with the progressive win amount, and may cause the other display, monitor 306 for example, to show the reset progressive pool amount.

In cases where a progressive win signal is communicated to group display controller 404, the group display controller may send back an acknowledgement or confirmation signal to the progressive winning gaming machine. Alternatively, the progressive winning gaming machine may communicate the progressive win signal to each gaming machine in the progressive game bank or interconnected banks, and each gaming machine may then acknowledge the progressive win communication and reset its respective local progressive register to the base amount for the progressive prize that has been won. Each gaming machine may then transmit its updated local progressive contribution value to group display controller 404 which resets the total progressive value accordingly and causes the new progressive total value to be displayed on one or more group display devices.

In some implementations of the present invention, whether a given gaming machine in the network is enabled for progressive play may be set by an authorized technician accessing a setup routine at the gaming machine. If the technician enables the gaming machine for progressive play according to the invention, the process conducted at the gaming machine may be as shown in FIG. 6 from process block 612 through process block 624.

Some implementations of the invention may rely on functionality added to existing programs executed at the gaming machine to facilitate the progressive contribution calculation and total progressive value maintenance at the gaming machine. For example, some gaming systems employ program code executed at the game processor of a gaming machine such as CPU 205 in FIG. 2, to load particular game software at the gaming machine. This game loading control software may be modified according to forms of the present invention to add functionality to receive a game payout rate percentage, progressive set aside percentage or value (a fixed or variable value), and to calculate the progressive contribution value as indicated at process block 614 in FIG. 6, and increment a local register (physical or virtual) to maintain/calculate the total progressive value, and cause the calculated progressive contribution value to be communicated to other gaming machines. The game loading software executed at these other gaming machines, or other software may then independently calculate the total progressive value for display at that gaming machine.

The above discussion related to FIG. 6 generally refers to a single progressive total value. It should be appreciated, however, that the invention is not limited to a single progressive value. Rather, progressive games may be implemented according to the invention in which a given wager amount contributes to multiple different progressive pools simultaneously, or one of multiple progressive pools depending upon one or more factors, such as the level of the wager for example. In these multiple progressive implementations, the calculations and operations indicated at process blocks 614, 615, 617, and 622 may be performed for each of the different progressive totals being maintained. Also each different progressive pool may have a different trigger as the progressive prize winning event for that pool.

It will be appreciated that the various method steps described above in connection with FIG. 6 may be performed by a gaming machine such as gaming machine 100 described above under the control of program code executed by a processing device associated with the gaming machine. The program code may be stored in a suitable non-transitory medium such as non-volatile memory 207 in FIG. 1 and loaded into random access memory 206 for execution by processor 205. The program product may include game program code which is executable to receive game play inputs as shown at process blocks 604 and 612 in FIG. 6, and to obtain results and award prizes as indicated at process blocks 606 and 624. The contribution calculation shown at process block 614, the communication indicated at process block 615 (both sending and receiving contribution amounts according to the respective embodiment), and the total calculation shown at process block 617 may be performed by progressive program code executed at the gaming machine. The initialization for progressive play as indicated at process block 610 in FIG. 6 may be performed by progressive participation stated program code executed at the gaming machine.

As used in the foregoing description and the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above-described example embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for providing a progressive prize in a gaming system, the method including:

(a) receiving one or more game play inputs through a respective player input system of each of two or more gaming machines in a progressive game participation state, each game play input defining a wager for a respective play of a wagering game;

(b) calculating a progressive contribution value for each respective wager, the calculation being performed at a respective processor associated with the respective gaming machine at which the respective wager is defined;

(c) communicating the respective progressive contribution value calculated for a respective wager from the respective gaming machine at which the respective wager is defined to each other gaming machine of the two or more gaming machines;

(d) at each gaming machine, receiving the respective progressive contribution value calculated for a respective wager and communicated from another one of the gaming machines, and maintaining a total progressive value, the total progressive value comprising the total cumulative value of all calculated progressive contribution values;

(e) at each gaming machine, displaying the total progressive value at a display device associated with the respective gaming machine; and (f) in response to a progressive prize winning event at one of the gaming machines, awarding at least a portion of the current total progressive value for the progressive prize winning event.

2. The method of claim 1 further including for each respective wager, incrementing a local progressive register value at the respective gaming machine by the progressive contribution value calculated for that wager.

3. The method of claim 1 further including receiving a progressive participation input through the respective player input system of at least one of the gaming machines to place that gaming machine in the progressive game participation state.

4. The method of claim 3 further including adjusting a payout rate at the respective gaming machine in response to the progressive participation input, the payout rate being adjusted by a processing device associated with the gaming machine.

5. The method of claim 3 further including, in response to the progressive participation input, adding a progressive wager amount to a base wager amount to produce the defined wager amount for a respective play of the wagering game at that respective gaming machine, the base wager amount being an amount selected by a player through the respective player input system for that gaming machine.

6. The method of claim 1 further including communicating the respective progressive contribution value calculated for a respective wager to a host controller for the two or more gaming machines, and maintaining the total progressive value at the host controller.

7. The method of claim 6 wherein the host controller is connected to control a group video display device and further including displaying the total progressive value at the group video display device under control of the host controller.

8. A gaming system including:

(a) a first gaming machine placed in a respective progressive game participation state, the first gaming machine including a player input system, at least one gaming machine processor, and at least one memory device storing instructions executable by the first gaming machine processor;

(b) a second gaming machine placed in a respective progressive game participation state, the second gaming machine including a player input system, at least one gaming machine processor, and at least one memory device storing instructions executable by the second gaming machine processor; and (c) wherein the instructions executable by the first gaming machine processor and the instructions executable by the second gaming machine processor are each executable to:

(i) receive one or more game play inputs through the respective player input system, each game play input defining a wager for a respective play of a wagering game, (ii) calculate a progressive contribution value for each respective wager, (iii) communicate the progressive contribution value calculated for a respective wager to each other gaming machine of the two or more gaming machines, (iv) at each gaming machine, receive the respective progressive contribution value calculated for a respective wager and communicated from another one of the gaming machines, and maintain a total progressive value, the total progressive value comprising the total cumulative value of all calculated progressive contribution values, and (v) at each gaming machine, display the total progressive value at a display device associated with the respective gaming machine.

9. The gaming system of claim 8:

(a) wherein the instructions executable by the first gaming machine processor and the instructions executable by the second gaming machine processor are each executable to communicate the respective progressive contribution value calculated for a respective wager to a host controller; and (b) further including a host controller having at least one host controller processor, and at least one memory device storing instructions executable by the at least one host controller processor to receive the respective progressive contribution value calculated for a respective wager and maintain a total progressive value at the host controller.

10. The gaming system of claim 9 further including a group display device operatively connected to the host controller, and wherein the instructions executable by the at least one host controller processor are executable to cause the group display device to display the total progressive value.

11. The gaming system of claim 8 wherein the instructions executable by the first gaming machine processor and the instructions executable by the second gaming machine processor are each executable to, for each respective wager, increment a local progressive register value at the respective gaming machine by the progressive contribution value calculated for that wager.

12. The gaming system of claim 8 wherein a respective memory device of each gaming machine also stores instructions executable by the respective gaming machine processor of that gaming machine to award at least a portion of the current total progressive value in response to a progressive prize winning event.

13. The gaming system of claim 8 wherein the instructions executable by the first gaming machine processor are executable to receive a progressive participation input through the respective player input system of the first gaming machine to place that gaming machine in the progressive game participation state.

14. The gaming system of claim 13 wherein the instructions executable by the first gaming machine processor are executable to adjust a payout rate at the first gaming machine in response to the progressive participation input.

15. The gaming system of claim 13 wherein the instructions executable by the first gaming machine processor are executable to add a progressive wager amount to a base wager amount to produce the defined wager amount for a respective play of the wagering game at the first gaming machine, the base wager amount being an amount selected by a player through the player input system for the first gaming machine.

16. A program product comprising one or more non-transitory computer readable media storing program code, the program code including:

(a) game program code executable by at least one processor associated with a first gaming machine to, (i) receive one or more game play inputs through a respective player input system of the first gaming machine, each game play input defining a wager for a respective play of a wagering game, and (ii) cause a result to be presented for the respective play of the wagering game; and (b) progressive program code executable by at least one processor associated with the first gaming machine to, (i) calculate a progressive contribution value for each respective wager, made when the first gaming machine is in a progressive participation state, (ii) communicate the progressive contribution value calculated for a respective wager to a second gaming machine, (iii) receive a progressive contribution value calculated for a respective wager placed at the second gaming machine, and (iv) maintain a total progressive value, the total progressive value comprising the total cumulative value of all progressive contribution values calculated at the first gaming machine and received from the second gaming machine.

17. The program product of claim 16 wherein the game program code is also executable to award at least a portion of the current total progressive value in response to a progressive prize winning event.

18. The program product of claim 16 further including progressive participation state program code executable by at least one processor associated with the first gaming machine to receive a progressive participation input through the player input system of the first gaming machine and to place the first gaming machine in the progressive participation state.

19. The program product of claim 18 wherein the progressive participation state program code is also executable to adjust a payout rate at the first gaming machine in response to the progressive participation input.

20. The program product of claim 18 wherein the progressive participation state program code is also executable to add a progressive wager amount to a base wager amount to produce the defined wager amount for a respective play of the wagering game at the first gaming machine, the base wager amount being an amount selected by a player through the player input system for the first gaming machine.

* * * * *